US009423747B1

(12) United States Patent
Ishibashi et al.

(10) Patent No.: US 9,423,747 B1
(45) Date of Patent: Aug. 23, 2016

(54) IMAGE FORMING APPARATUS HAVING UNIT SPECIFYING WHICH IMAGE FORMING SECTION ATTACHES DEVELOPER

(71) Applicant: FUJI XEROX CO., LTD., Tokyo (JP)

(72) Inventors: Junichi Ishibashi, Kanagawa (JP); Satoshi Tanaka, Kanagawa (JP); Keiji Sanekata, Kanagawa (JP); Shinji Mitsui, Kanagawa (JP); Chihiro Hagiwara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/788,020

(22) Filed: Jun. 30, 2015

(30) Foreign Application Priority Data

Mar. 10, 2015 (JP) ..... 2015-047227

(51) Int. Cl.
*G03G 15/00* (2006.01)
*G03G 15/08* (2006.01)

(52) U.S. Cl.
CPC ..... *G03G 15/5008* (2013.01); *G03G 15/0848* (2013.01)

(58) Field of Classification Search
CPC ..... G03G 15/5008
See application file for complete search history.

(56) References Cited

U.S. PATENT DOCUMENTS 8,483,583 B2 7/2013 Takehara et al.
2012/0148315 A1* 6/2012 Nakashima ..... G03G 15/5054 399/301

FOREIGN PATENT DOCUMENTS

JP 2004347929 A 12/2004
JP 2009210774 A 9/2009
JP 2011186038 A 9/2011

* cited by examiner

*Primary Examiner* — Clayton E LaBalle
*Assistant Examiner* — Victor Verbitsky
(74) *Attorney, Agent, or Firm* — Oliff PLC

(57) ABSTRACT

An image forming apparatus includes image forming sections each including a developing section having a developer bearing member and a developer supply unit and a transfer unit that transfers an image developed on a photoconductor by the developing unit onto a transfer body, a controller that controls a driving time of the developer bearing member so that developer is born on the developer bearing member during a period when image formation is not performed and the developer attached to the transfer body by the image forming sections does not overlap, a detector that detects the attached developer by each image forming section, and a specification unit that specifies the image forming section which attaches the developer to the transfer body, on the basis of a time from when the controller starts driving the developer bearing member to when the detector detects the developer attached to the transfer body.

4 Claims, 5 Drawing Sheets

IMAGE FORMING APPARATUS HAVING UNIT SPECIFYING WHICH IMAGE FORMING SECTION ATTACHES DEVELOPER

CROSS-REFERENCE TO RELATED APPLICATIONS

This application is based on and claims priority under 35 USC 119 from Japanese Patent Application No. 2015-047227 filed Mar. 10, 2015.

BACKGROUND

Technical Field

The present invention relates to an image forming apparatus.

SUMMARY

According to an aspect of the invention, there is provided an image forming apparatus including: plural image forming sections arranged in a transport direction of a transfer body transported at a predetermined speed and each including a developing section having a developer bearing member that develops an electrostatic latent image formed on a photoconductor and a developer supply unit that supplies developer to the developer bearing member, and a transfer unit that transfers the image on the photoconductor developed by the developing section onto the transfer body; a controller that controls a driving time of the developer bearing member included in each of the plural image forming sections so that the developer is born on the developer bearing member included in each of the plural image forming sections without forming the electrostatic latent image on the photoconductor during a period in which image formation is not performed in each of the plural image forming sections and so that the developer attached to the transfer body by the plural image forming sections does not overlap; a detector that detects the developer attached to the transfer body by each of the plural image forming sections; and a specification unit that specifies the image forming section which attaches the developer to the transfer body, from the plural image forming sections, on the basis of a time from when the controller starts driving the developer bearing member to when the detector detects the developer attached to the transfer body.

BRIEF DESCRIPTION OF THE DRAWINGS

An exemplary embodiment of the present invention will be described in detail based on the following figures, wherein.

DETAILED DESCRIPTION

Figure 1:
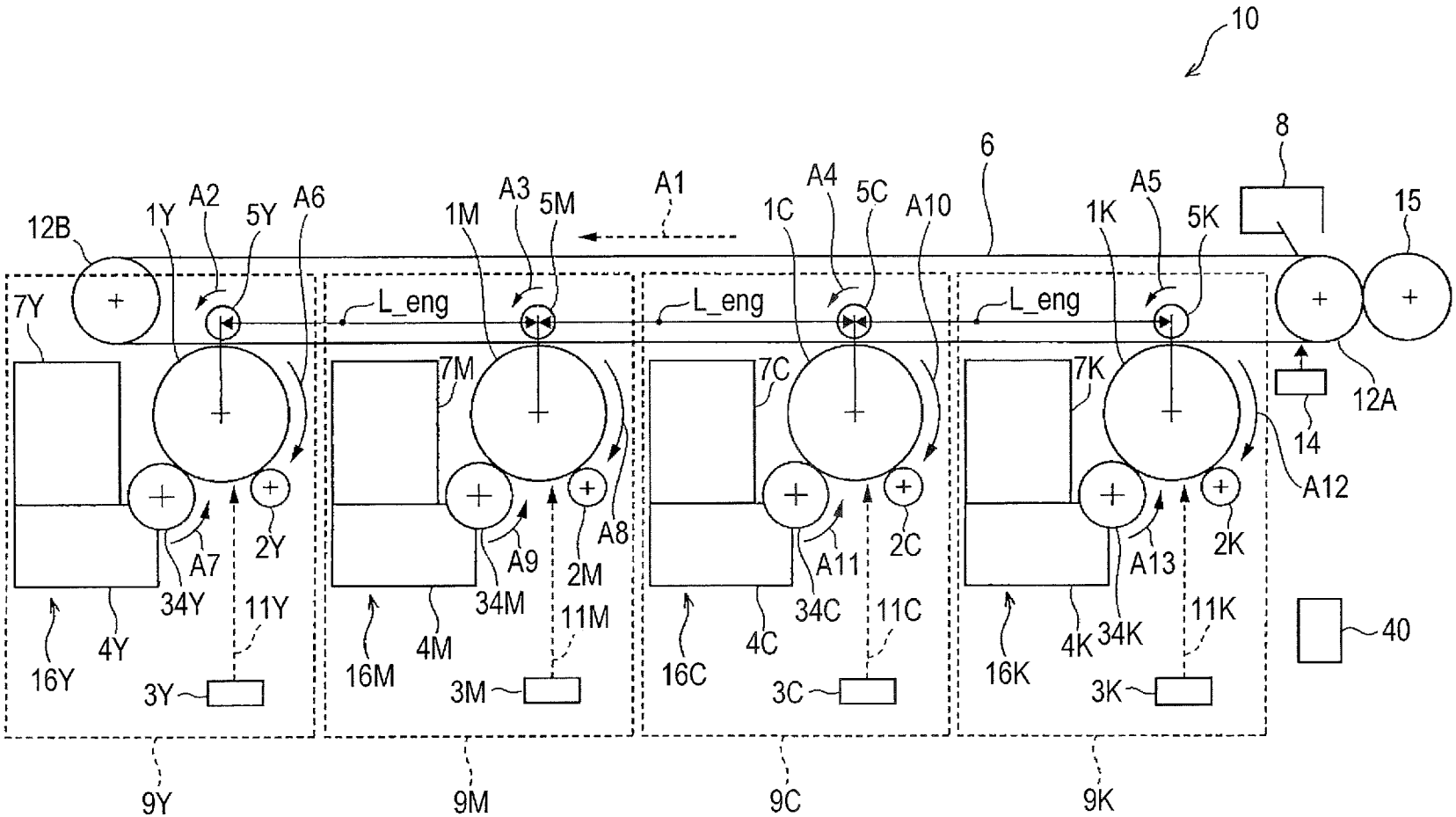
FIG. 1 is a schematic structural view illustrating an example of a principal structural section in an image forming apparatus.

An exemplary embodiment of the present invention will be described below. Constituent elements and processes that provide the same operations or the same functions are denoted by the same reference numerals through all drawings, and redundant descriptions thereof are sometimes omitted appropriately. Further, yellow, magenta, cyan, and black are represented by Y, M, C, and K, respectively. When there is a need to discriminate among the members on the basis of colors, the members are discriminated by adding color signs (Y, M, C, and K) corresponding to the colors to the ends of the reference numerals of the members. When the members are shown without being discriminated on the basis of the colors, the color signs to be added to the ends of the reference numerals are omitted.

FIG. 1 is a schematic side view illustrating the principal configuration of an image forming apparatus 10 using an electrophotographic system according to an exemplary embodiment. The image forming apparatus 10 is equipped with an image forming function that receives various data through an unillustrated communication line and performs a color image forming process on the basis of the received data.

The image forming apparatus 10 includes four photoconductors 1Y, 1M, 1C, and 1K (photoconductors 1) and chargers 2Y, 2M, 2C, and 2K (chargers 2) corresponding to colors of Y, M, C, and K. The photoconductors 1Y, 1M, 1C, and 1K rotate in directions of arrows A6, A8, A10, and A12 in FIG. 1, respectively. The chargers 2Y, 2M, 2C, and 2K charge surfaces of the photoconductors 1Y, 1M, 1C, and 1K, respectively, by applying a charging bias thereto. As the photoconductors 1Y, 1M, 1C, and 1K, photoconductors regarded as having the same diameter are used.

The image forming apparatus 10 further includes laser output units 3Y, 3M, 3C, and 3K and developing rollers 34Y, 34M, 34C, and 34K (developing rollers 34) serving as developer bearing members. The laser output units 3Y, 3M, 3C, and 3K expose the charged surfaces of the photoconductors 1 to light modulated on the basis of image information of the colors to form electrostatic latent images on the photoconductors 1. The developing rollers 34Y, 34M, 34C, and 34K bear charged developers (toners) corresponding to the colors on their surfaces by a developing bias applied from an unillustrated developing power supply, and rotate in directions of arrows A7, A9, A11, and A13, respectively, so as to attach the corresponding color toners to the photoconductors 1 and to thereby develop the electrostatic latent images on the photoconductors 1 with the corresponding color toners to form toner images on the photoconductors 1. As the developing rollers 34Y, 34M, 34C, and 34K, developing rollers regarded as having the same diameter are used.

The image forming apparatus 10 further includes developing units 4Y, 4M, 4C, and 4K (developing units 4) and toner supply units 7Y, 7M, 7C, and 7K (toner supply units 7). The developing units 4Y, 4M, 4C, and 4K attach the corresponding color toners onto the surfaces of the developing rollers 34 so that the toners are born thereon. The toner supply units 7Y, 7M, 7C, and 7K supply the corresponding color toners to the developing units 4.

The developing rollers 34, the developing units 4, and the toner supply units 7 are sometimes generically referred to as developing sections 16.

The image forming apparatus 10 further includes first transfer units 5Y, 5M, 5C and 5K. The first transfer units 5Y, 5M, 5C, and 5K rotate in directions of arrows A2, A3, A4, and A5, respectively, to assist in transportation of an intermediate transfer belt 6 serving as an endless belt and to transfer color toner images on the photoconductors 1 onto the intermediate transfer belt 6. The image forming apparatus 10 further includes transport rollers 12A and 12B that are connected to an unillustrated transport motor and that transport the laid intermediate transfer belt 6 at a predetermined transport speed. When the intermediate transfer belt 6 is transported in a direction of arrow A1, that is, in a direction from the transport roller 12A to the transport roller 12B, it is turned back by the transport roller 12B, and is next transported in a direction from the transport roller 12B to the transport roller 12A. Then, the intermediate transfer belt 6 is turned back by the transport roller 12A again. In this way, turn-back transportation of the intermediate transfer belt 6 is performed.

The image forming apparatus 10 further includes a belt cleaner 8. The belt cleaner 8 cleans off residual toner from a surface of the intermediate transfer belt 6 after a toner image on the intermediate transfer belt 6 is transferred onto unillustrated recording paper that passes through, for example, a gap formed by the transport roller 12A and a second transfer unit 15.

A toner detection sensor 14 is disposed at a position opposed to an image transfer surface of the intermediate transfer belt 6. The toner detection sensor 14 detects toner on the intermediate transfer belt 6, converts the detected toner amount into a physical amount such as a voltage value, and outputs the physical amount to a controller 40 to be described later. From the viewpoint of cost, the toner detection sensor 14 does not have a function of discriminating among colors. Since the toner detection sensor 14 detects the amount of toner transferred on the intermediate transfer belt 6 by the first transfer units 5, it is preferably disposed on a transport path of the intermediate transfer belt 6 from a position where toner images are transferred on the intermediate transfer belt 6 to a position where the toner images on the intermediate transfer belt 6 are transferred on unillustrated recording paper. As the toner detection sensor 14, sensors using known methods, such as an optical sensor or a magnetic sensor, are used.

In this way, the image forming apparatus 10 includes image forming sections 9 arranged in the transport direction of the intermediate transfer belt 6 in correspondence to the Y, M, C, and K colors to form images corresponding to the colors on the intermediate transfer belt 6. The image forming sections 9 respectively include the photoconductors 1, the chargers 2, the laser output units 3, the first transfer units 5, and the developing sections 16. While the image forming sections 9 are arranged in the order of an image forming section 9Y, an image forming section 9M, an image forming section 9C, and an image forming section 9K from the upstream side to the downstream side in the transport direction of the intermediate transfer belt 6 in the exemplary embodiment illustrated in FIG. 1, the arrangement order of the image forming sections 9 corresponding to the colors is not limited. Further, the image forming sections 9 are arranged so that the distance between the transfer positions of toner images in the adjacent image forming sections 9 (adjacent transfer distance), that is, the distance between the positions where the photoconductors 1 included in the adjacent image forming sections 9 are pressed against the intermediate transfer belt 6 by the first transfer units 5 becomes a predetermined distance. In the following description, for example, the adjacent transfer distance between the adjacent image forming sections 9 is set at L_eng.

The photoconductors 1 corresponding to the Y, M, C, and K colors are rotated by an unillustrated common photoconductor driving motor. The developing rollers 34Y, 34M, and 34C corresponding to the Y, M, and C colors are rotated by an unillustrated common developing-roller driving motor. The developing roller 34K is rotated by a developing-roller driving motor different from the common developing-roller driving motor for driving the developing rollers 34Y, 34M, and 34C.

The chargers 2 corresponding to the Y, M, C, and K colors are connected to an unillustrated common charging power supply, and a charging bias is applied thereto. The developing rollers 34Y, 34M, and 34C corresponding to the Y, M, and C colors are connected to an unillustrated common developing power supply, and a developing bias is applied thereto. The developing roller 34K is connected to a developing power supply different from the common developing power supply connected to the developing rollers 34Y, 34M, and 34C, and a developing bias is applied thereto.

The photoconductor driving motor and the charging power supply are common to the image forming sections 9 corresponding to the Y, M, C, and K colors and the developing-roller driving motor and the developing power supply are common to the image forming sections 9Y, 9M, and 9C corresponding to the Y, M, and C colors in order to reduce the number of components and the total cost of the image forming apparatus 10.

The reason why the developing-roller driving motors and the developing power supplies are not common to all of the image forming sections 9 corresponding to the Y, M, C, and K colors, but are divided into the developing-roller driving motor and the developing power supply for the Y, M, and C colors and the developing-roller driving motor and the developing power supply for the K color is that, when a black-and-white image is formed, it is only necessary to develop a latent image on the photoconductor 1K and it is unnecessary to perform the developing process in the image forming sections 9Y, 9M, and 9C.

The image forming apparatus 10 further includes a controller 40 that controls controlled members included in the image forming apparatus 10, for example, the image forming sections 9, the toner detection sensor 14, the unillustrated transport motor, the photoconductor driving motor, the developing-roller driving motors, the charging power supply, and the developing power supplies.

Next, an image forming operation of the image forming apparatus 10 illustrated in FIG. 1 will be described.

First, for example, original image information about an image to be formed is output from an unillustrated terminal apparatus, such as a personal computer, to the image forming apparatus 10 through an unillustrated communication line.

When the original image information is input to the image forming apparatus 10, the image forming apparatus 10 drives the photoconductors 1, and applies a charging bias to the chargers 2 to negatively charge the surfaces of the photoconductors 1.

On the other hand, the original image information is input to the controller 40 in the image forming apparatus 10. The controller 40 resolves the original image information into image data of the Y, M, C, and K colors, and then outputs modulation signals based on the image data of the colors to the laser output units 3 corresponding to the colors. The laser output units 3 that receive the modulation signals output laser beams 11 modulated according to the input modulation signals.

The modulated laser beams 11 are radiated onto the surfaces of the photoconductors 1. While the surfaces of the photoconductors 1 are negatively charged by the chargers 2, when they are irradiated with the laser beams 11, charges in portions irradiated with the laser beams 11 dissipate, and electrostatic latent images corresponding to the image data of the Y, M, C, and K colors included in the original image information are formed on the photoconductors 1.

On the other hand, the toner in the developing units 4 is attached to the surfaces of the developing rollers 34 by rotating the developing rollers 34. At this time, since a negative developing bias is applied to the developing rollers 34, negatively charged toner is attached to the surfaces of the developing rollers 34.

When the negative developing bias is applied to the developing rollers 34, the toner attached from the developing units 4 to the surfaces of the developing rollers 34 is negatively charged. Then, the developing rollers 34 start rotation.

When the electrostatic latent images formed on the photoconductors 1 are transported to positions opposed to the developing rollers 34, the negatively charged toner attached to the surfaces of the developing rollers 34 is electrically attracted to the electrostatic latent images formed on the photoconductors 1 to develop the electrostatic latent images, whereby toner images corresponding to the image data of the colors in the original image information are formed on the photoconductors 1.

Further, the transport rollers 12A and 12B are rotated by the unillustrated transport motor, and the intermediate transfer belt 6 is transported to gaps formed by the first transfer units 5 and the photoconductors 1, so that the intermediate transfer belt 6 is pressed against the photoconductors 1. At this time, a first transfer bias is applied by the first transfer units 5, and the toner images corresponding to the image data of the colors formed on the photoconductors 1 are thereby transferred onto the intermediate transfer belt 6. Therefore, the color toner images are superimposed and a toner image corresponding to the original image information is transferred on the intermediate transfer belt 6 by controlling the transfer timing so that the transfer start positions of the color toner images on the intermediate transfer belt 6 coincide with one another.

When the toner image transferred on the intermediate transfer belt 6 is transported to a gap formed by the transport roller 12A and the second transfer unit 15, the intermediate transfer belt 6 is pressed against unillustrated recording paper transported to the gap through another path. At this time, a second transfer bias is applied by the second transfer unit 15, and the toner image transferred on the intermediate transfer belt 6 is thereby transferred onto the unillustrated recording paper.

After the toner image is transferred on the unillustrated recording paper, substances attached to the surface of the intermediate transfer belt 6, such as residual toner, are removed by the belt cleaner 8. Further, after the toner images are transferred on the intermediate transfer belt 6, substances attached to the surfaces of the photoconductors 1, such as residual toner, are removed by an unillustrated cleaning device.

Through the above procedure, the image corresponding to the original image information is formed on the unillustrated recording paper, and a series of image forming operations are completed.

With execution of these image forming operations, soil with toner different from the toner image corresponding to the original image information, that is, so-called "fogging" sometimes occurs on the intermediate transfer belt 6. While there are plural causes of fogging, for example, it is conceived that fogging is caused because the surfaces of the photoconductors 1 are not charged at a predetermined potential owing to deterioration of the members of the chargers 2 over time and toner is attached to portions other than the latent images formed on the photoconductors 1.

Therefore, when fogging occurs in the image forming apparatus 10, a larger amount of toner than the amount of toner designated by the user to form the toner images corresponding to the image data is consumed.

On the other hand, to suppress variation in image density, the developing units 4 each preferably contain a predetermined amount of toner so that the density of toner used for development is close to a target toner density. For that purpose, there is a need to supply an amount of toner corresponding to the amount of toner consumed by image formation from the toner supply units 7 to the developing units 4.

Since a toner image is formed according to pixel values of pixels included in the image data, the amount of toner to be used to form the toner image is calculated from the pixel values of the pixels included in the image data. However, it is difficult to calculate the amount of toner to be consumed by fogging from the image data. Therefore, an image forming section 9 where fogging occurs is specified and an amount of toner corresponding to the amount of toner to be consumed by fogging is supplied to the developing unit 4 in the specified image forming section 9 in addition to the amount of toner to be used to form a toner image. This allows a predetermined amount of toner to be contained in the developing unit 4.

However, as described above, since the toner detection sensor 14 does not have a function of discriminating among the colors of toner from the viewpoint of cost, even if the toner detection sensor 14 detects the occurrence of fogging, it is difficult to specify an image forming section 9 where fogging occurs.

Therefore, a description will be given below of a process of the image forming apparatus 10 for specifying an image forming section 9 where fogging occurs, in the plural image forming sections 9.

Figure 2:
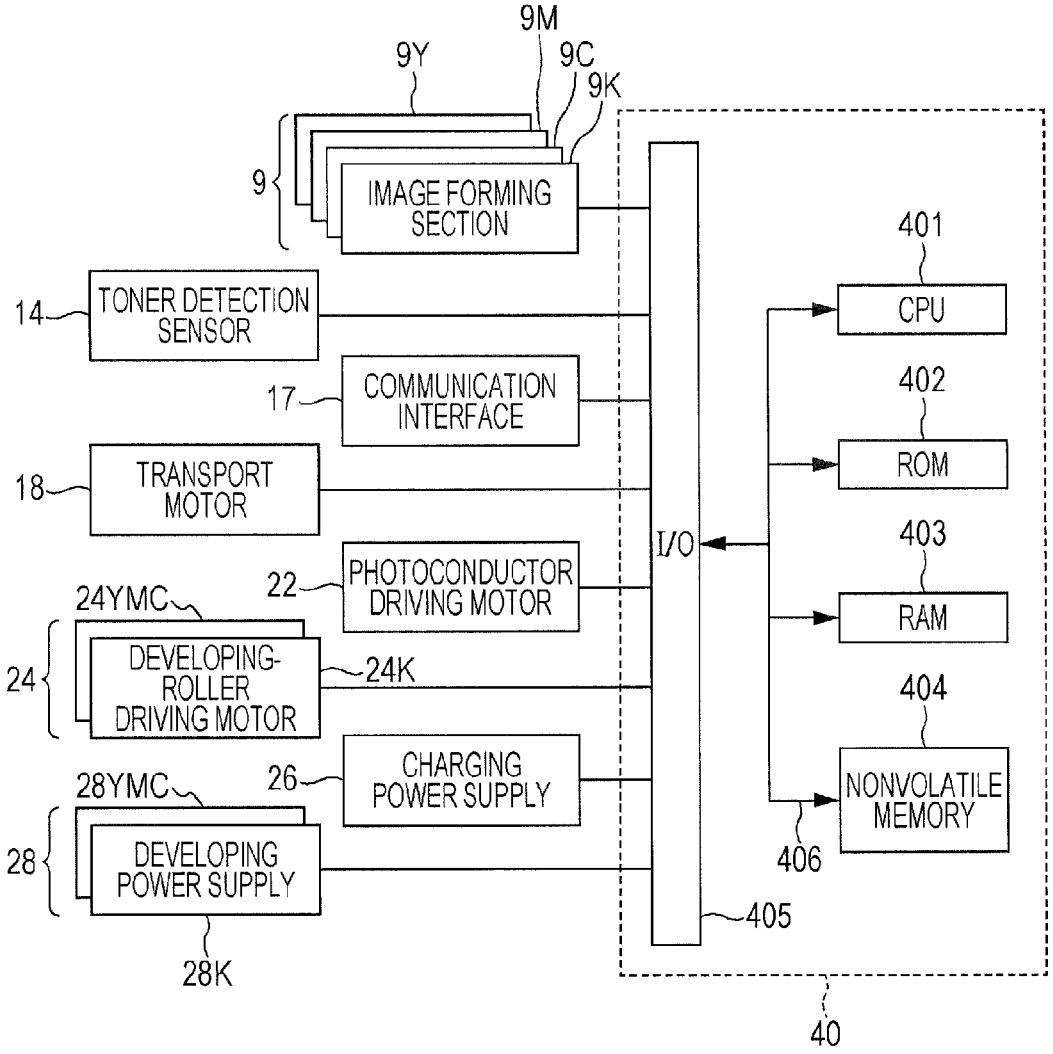
FIG. 2 illustrates an example of a principal configuration of an electric system in the image forming apparatus.

As illustrated in FIG. 2, the controller 40 of the image forming apparatus 10 according to the exemplary embodiment is implemented by, for example, a computer 40. In the computer 40, a central processing unit (CPU) 401, a read only memory (ROM) 402, a random access memory (RAM) 403, a nonvolatile memory 404, and an input/output interface (I/O) 405 are connected through a bus 406. To the I/O 405, the image forming sections 9, the toner detection sensor 14, a communication interface 17, a transport motor 18, a photoconductor driving motor 22, developing-roller driving motors 24, a charging power supply 26, and developing power supplies 28 are connected.

The transport motor 18 is a driving motor that drives the transport rollers 12A and 12B to transport the intermediate transfer belt 6.

The photoconductor driving motor 22 is a driving motor that drives the photoconductors 1 corresponding to the Y, M, C, and K colors. The developing-roller driving motors 24 refer to a generic term for a developing-roller driving motor 24YMC that commonly drives the developing rollers 34Y, 34M, and 34C and a developing-roller driving motor 24K that drives the developing roller 34K.

The charging power supply 26 applies a charging bias to the chargers 2 corresponding to the Y, M, C, and K colors. The developing power supplies 28 refer to a generic term for a developing power supply 28YMC that applies a developing bias to the developing rollers 34Y, 34M, and 34C and a driving power supply 28K that applies a developing bias to the developing roller 34K.

The communication interface 17 exchanges data with an unillustrated terminal apparatus through an unillustrated communication line.

For example, programs to be executed by the computer 40 are written in the ROM 402 beforehand, and the CPU 401 reads out the programs from the ROM 402 and executes the programs. The programs to be executed by the CPU 401 may be offered by a recording medium such as a CD-ROM, or may be downloaded from the unillustrated terminal apparatus via the communication interface 17.

Figure 3:
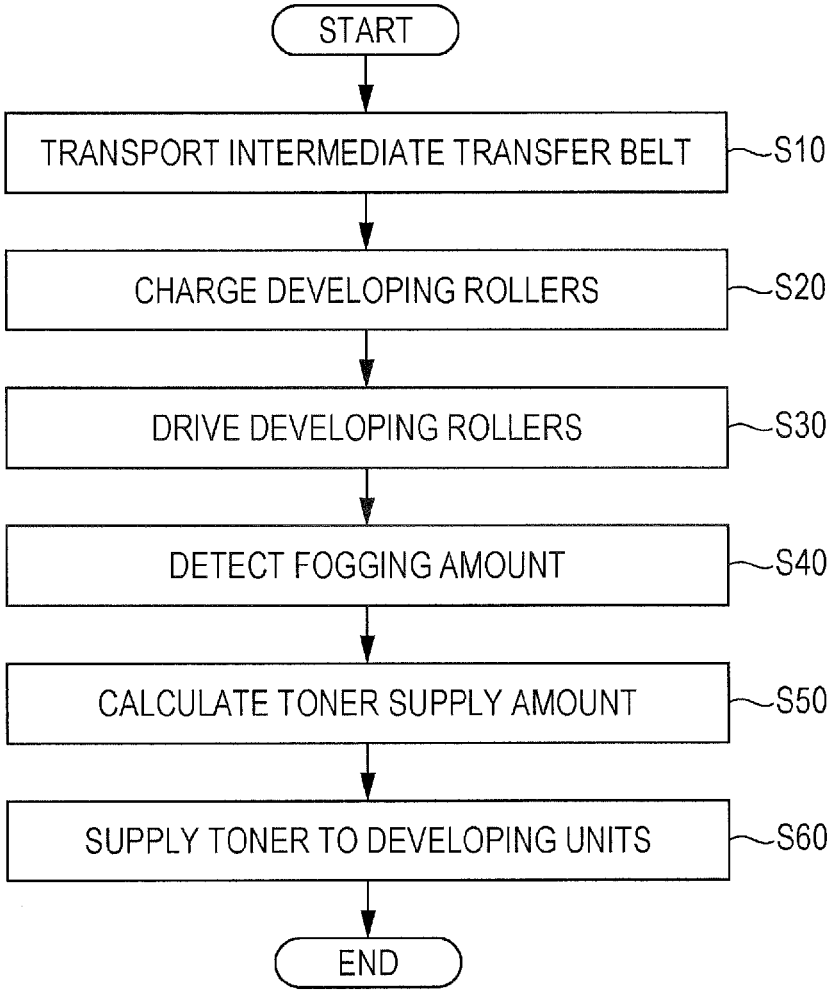
FIG. 3 is a flowchart showing an example of a flow of a program that specifies an image forming section where fogging occurs.

FIG. 3 is a flowchart showing the flow of an operation of a program executed by the CPU 401 in the computer 40 to specify an image forming section 9 where fogging occurs. The program shown in FIG. 3 is executed at a time when an image designated by the user (user image) is not formed, for example, during initialization performed after start-up of the image forming apparatus 10 or during a period from when a user image is formed to when the next user image is formed.

First, in Step S10, the transport motor 18 and the photoconductor driving motor 22 are driven to transport the intermediate transfer belt 6 at a predetermined transport speed S_blt, and the charging power supply 26 is turned on to apply a charging bias therefrom to the photoconductors 1. At this time, laser beams 11 are not output from the laser output units 3. The rotation speed of the photoconductors 1 is equal to the transport speed S_blt.

In Step S20, the developing power supply 28YMC and the developing power supply 28K are turned on to apply a developing bias from the developing power supply 28YMC to the developing rollers 34Y, 34M, and 34C and to apply a developing bias from the developing power supply 28K to the developing roller 34K. Thus, toner born on the developing rollers 34 is charged.

In Step S30, the developing-roller driving motor 24YMC and the developing-roller driving motor 24K are driven at as equal a timing as possible to attach the toner born on the developing rollers 34 to the photoconductors 1.

In this case, since the output from the laser output units 3 is stopped by the operation of Step S10, latent images are not formed on the photoconductors 1. Therefore, since the image forming sections 9 form so-called blank images that do not include any toner image, if fogging does not occur in any of the image forming sections 9, toner is not attached to the intermediate transfer belt 6.

Conversely, when toner is attached to the intermediate transfer belt 6 by the operation of Step S30, fogging occurs in the image forming sections 9.

Therefore, the driving time of the developing-roller driving motor 24YMC and the developing-roller driving motor 24K is limited to less than L_eng/S_blt so that toners attached to the intermediate transfer belt 6 by fogging occurring in the image forming sections 9 are separately attached to the intermediate transfer belt 6 and do not overlap with one another.

Here, the time L_eng/S_blt calculated from the adjacent transfer distance L_eng and the transport speed S_blt of the intermediate transfer belt 6 refers to the time needed to transport toner, which is transferred on the intermediate transfer belt 6 at the transfer position, that is, in the gap between the photoconductor 1 and the first transfer unit 5 in one of the adjacent image forming sections 9, to the transfer position in the other image forming section 9. Hereinafter, "time L_eng/S_blt" is designated as time "$T_1$". Therefore, when the driving time of the developing-roller driving motor 24YMC and the developing-roller driving motor 24K is limited to less than $T_1$, toners attached to the intermediate transfer belt 6 by fogging in the image forming sections 9 are separately attached to the intermediate transfer belt 6.

In Step S40, the amount of toner attached to the transported intermediate transfer belt 6 is detected by the toner detection sensor 14.

Since the driving time of the developing-roller driving motor 24YMC and the developing-roller driving motor 24K is limited to less than $T_1$ in the operation of Step S30, toner attached to the intermediate transfer belt 6 by fogging is transported to the toner detection position from the image forming section 9 having the shorter toner transport path length.

Specifically, in the exemplary embodiment of FIG. 1, toner attached by fogging in the image forming section 9K (fogging toner K), toner attached by fogging in the image forming section 9C (fogging toner C), toner attached by fogging in the image forming section 9M (fogging toner M), and toner attached by fogging in the image forming section 9Y (fogging toner Y) are transported in this order to the toner detection position of the toner detection sensor 14.

The toner transport path length refers to the length of the toner transport path from the toner attachment position to the photoconductor 1 by the developing roller 34 to the toner detection position of the toner detection sensor 14 on the intermediate transfer belt 6.

When a time $T_0$ represents the time from when the developing-roller driving motor 24K is driven and the developing roller 34K is rotated to attach toner to the photoconductor 1K in the operation of Step S30 to when fogging toner K is transported to the toner detection position of the toner detection sensor 14, a time $T_K$ when the fogging toner K is detected by the toner detection sensor 14 is within a range such that $T_0 \leq T_K < (T_0+T_1)$. Here, the time $T_0$ is a value obtained by dividing the toner transport path length in the image forming section 9K by the transport speed S_blt.

Since the developing-roller driving motor 24YMC is driven at as equal a timing as possible to that of the developing-roller driving motor 24K, a time $T_C$ when the fogging toner C is detected by the toner detection sensor 14 is such that $(T_0+T_1) \leq T_C < (T_0+2T_1)$, a time $T_M$ when the fogging toner M is detected by the toner detection sensor 14 is such that $(T_0+2T_1) \leq T_M < (T_0+3T_1)$, and a time $T_Y$ when the fogging toner Y is detected by the toner detection sensor 14 is such that $(T_0+3T_1) \leq T_Y < (T_0+4T_1)$.

Therefore, for example, a timer incorporated in the CPU 401 is started at the time when the developing-roller driving motor 24YMC and the developing-roller driving motor 24K start to be driven. When toner is detected by the toner detection sensor 14 at a time T such that $T_0 \leq T < (T_0+T_1)$, it is specified that fogging occurs in the image forming section 9K. When toner is detected by the toner detection sensor 14 at a time T such that $(T_0+T_1) \leq T < (T_0+2T_1)$, it is specified that fogging occurs in the image forming section 9C. When toner is detected by the toner detection sensor 14 at a time T such that $(T_0+2T_1) \leq T < (T_0+3T_1)$, it is specified that fogging occurs in the image forming section 9M. When toner is detected at a time T such that $(T_0+3T_1) \leq T < (T_0+4T_1)$, it is specified that fogging occurs in the image forming section 9Y.

At this time, the toner detection sensor 14 outputs an output value corresponding to the amount of toner attached to the intermediate transfer belt 6 (fogging amount) that is estimated from, for example, the detected toner density.

Figure 4:
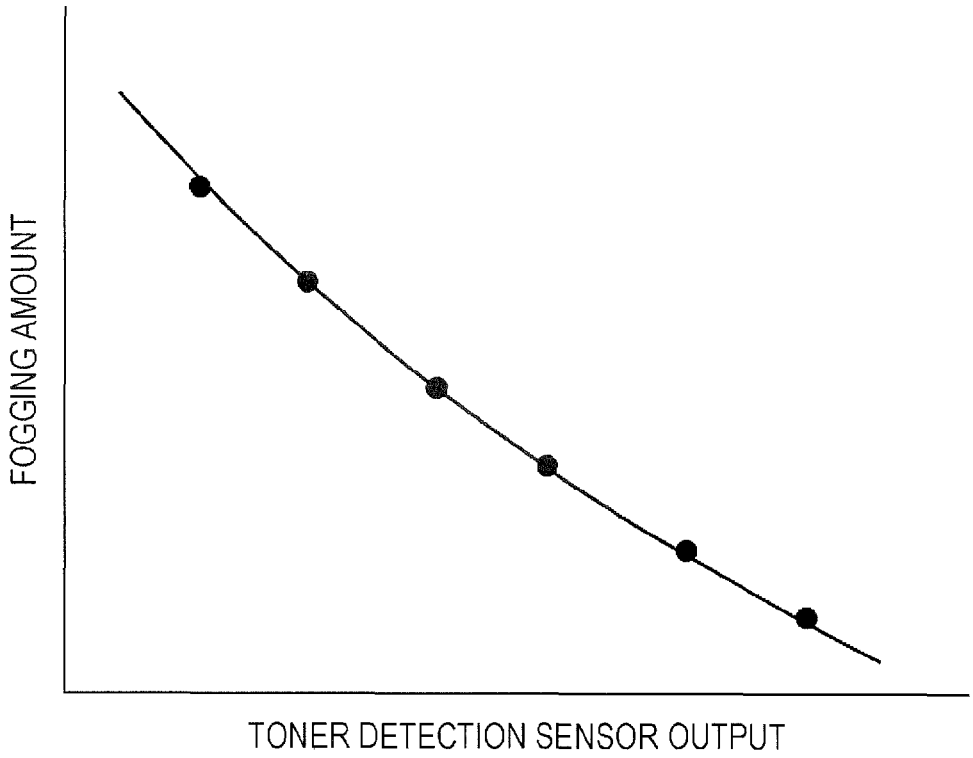
FIG. 4 is a graph showing the correspondence between the output of a toner detection sensor and the fogging amount.

FIG. 4 is a graph showing an example of output of the toner detection sensor 14 with respect to the fogging amount. As shown in FIG. 4, the toner detection sensor 14 outputs an output value that decreases as the detected fogging amount increases. The output value output from the toner detection sensor 14 may be any value such as a voltage value, a current value, or a resistance value. While the toner detection sensor 14 outputs an output value that decreases as the detected fogging amount increases in the example of FIG. 4, a toner detection sensor 14 for outputting an output value that increases as the detected fogging amount increases may be used.

In Step S50, the amount of toner to be supplied to the developing unit 4 in each of the image forming sections 9 is calculated from the fogging amount of the image forming section 9 that is acquired in the operation of Step S40.

In this case, a toner supply table that correlates the fogging amount and the amount of toner to be supplied to the developing unit 4 is prestored in a predetermined area of the nonvolatile memory 404, and the amount of toner to be supplied to the developing unit 4 may be calculated from the fogging amount acquired in the operation of Step S40 with reference to the toner supply table. Instead of the toner supply table, a function for calculating the amount of toner to be supplied to the developing unit 4 from the fogging amount may be prestored in the nonvolatile memory 404, and the amount of toner to be supplied to the developing unit 4 may be calculated by using the function.

In Step S60, the toner supply unit 7 in each of the image forming sections 9 is controlled so that the toner amount calculated in the operation of Step S50 is supplied to the developing unit 4 in the image forming section 9. At this time, in addition to the toner amount corresponding to the fogging amount, the toner supply unit 7 may be controlled so that an amount of toner calculated from the user image beforehand to be used to form a toner image corresponding to the user image is supplied to the developing unit 4.

Figure 5:
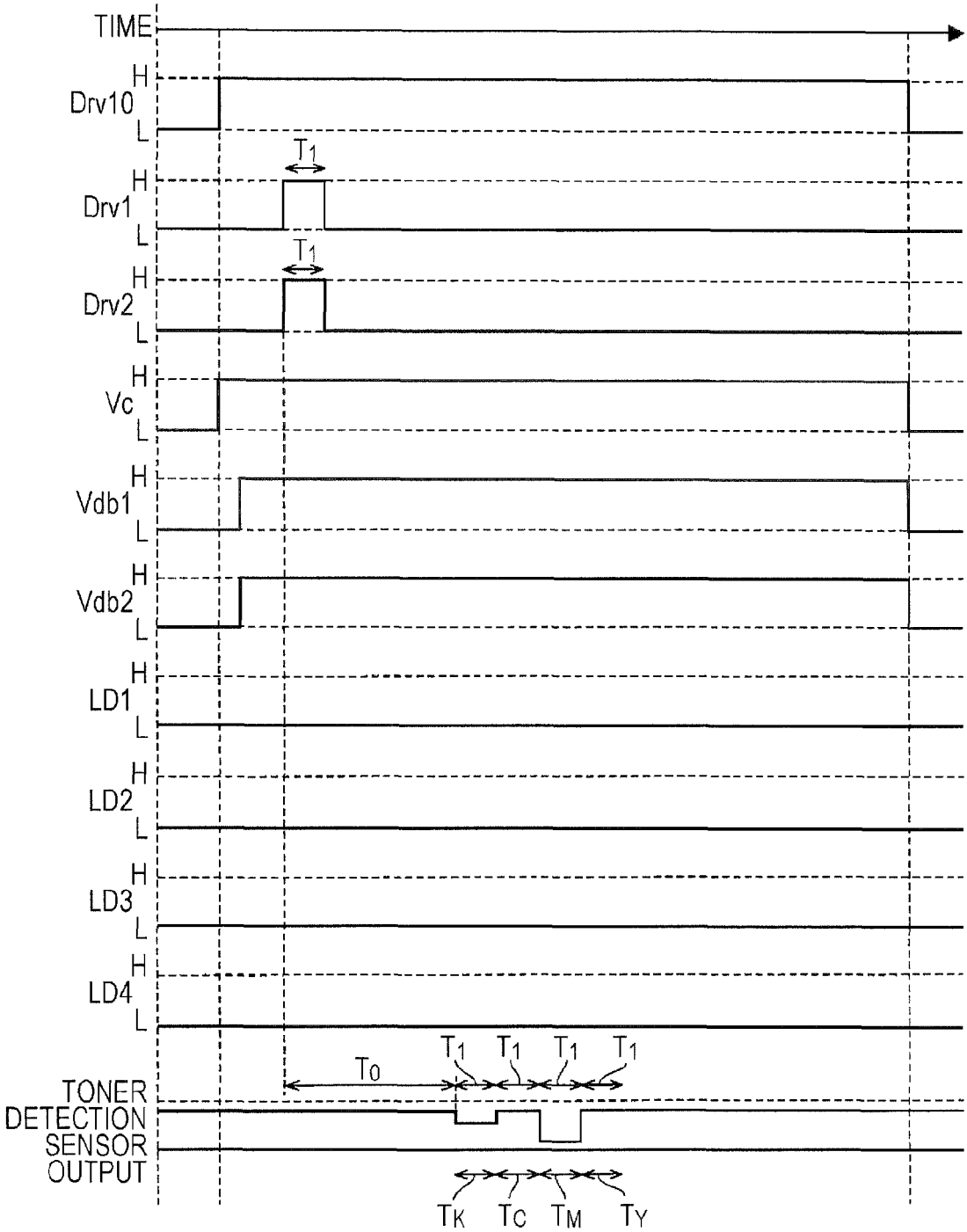
FIG. 5 is a timing chart showing an operation timing of the principal structural section when the program for specifying the image forming section where fogging occurs is executed.

FIG. 5 is an example of a timing chart of the operations of FIG. 3. The timing chart of FIG. 5 shows a case in which fogging occurs in the image forming section 9K and the image forming section 9M, and the horizontal axis of the timing chart indicates the time.

The timing chart of FIG. 5 includes a waveform Drv10 that represents the on/off state of the photoconductor driving motor 22, a waveform Drv1 that represents the on/off state of the developing-roller driving motor 24YMC, a waveform Drv2 that represents the on/off state of the developing-roller driving motor 24K, a waveform Vc that represents the on/off state of the charging power supply 26, a waveform Vdb1 that represents the on/off state of the developing power supply 28YMC, a waveform Vdb2 that represents the on/off state of the developing power supply 28K, a waveform LD1 that represents the on/off state of the laser output unit 3Y, a waveform LD2 that represents the on/off state of the laser output unit 3M, a waveform LD3 that represents the on/off state of the laser output unit 3C, a waveform LD4 that represents the on/off state of the laser output unit 3K, and an output waveform of the toner detection sensor 14. A state in which the waveform overlaps with a line "H" shows an on state, and a state in which the waveform overlaps with a line "L" shows an off state.

The photoconductor driving motor 22 and the charging power supply 26 are switched from an off state to an on state in the operation of Step S10, and the developing power supplies 28 are switched from an off state to an on state in the operation of Step S20. In the operation of Step S30, the developing-roller driving motors 24 are in an on state only during a period less than the time $T_1$.

The output value from the toner detection sensor 14 decreases as the detected fogging amount increases. Therefore, the output from the toner detection sensor 14 in FIG. 5 shows that fogging occurs in the image forming section 9K and the image forming section 9M, but fogging does not occur in the image forming section 9C and the image forming section 9Y. Further, the output from the toner detection sensor 14 at a time $T_M$ is smaller than the output from the toner detection sensor 14 at a time $T_K$, and this shows that the amount of fogging toner M in the image forming section 9M is larger than the amount of fogging toner K in the image forming section 9K.

In this way, according to the exemplary embodiment, toners attached to the intermediate transfer belt 6 by fogging in the image forming sections 9 do not overlap and are separately attached to the intermediate transfer belt 6 in the image forming sections 9 by limiting the time in which the photoconductors 1 are subjected to development with the developing rollers 34 to be less than $T_1$, that is, less than L_eng/S_blt. Therefore, even when the image forming apparatus 10 includes the image forming sections 9 corresponding to plural toner colors, the image forming section 9 where fogging occurs is specified by the single toner detection sensor 14.

Further, an amount of toner corresponding to the fogging amount is supplied to the developing unit 4 in the image forming section 9 where fogging occurs, by using the toner detection sensor 14 whose output changes according to the fogging amount.

The foregoing description of the exemplary embodiment of the present invention has been provided for the purposes of illustration and description. It is not intended to be exhaustive or to limit the invention to the precise forms disclosed.

While the operations shown in FIG. 3 are implemented by software configuration in the above-described exemplary embodiment, the present invention is not limited thereto. For example, the operations may be implemented by hardware configuration. In this case, speed-up of processing is expected compared with the above-described exemplary embodiment.

While the adjacent transfer distance between the adjacent image forming sections 9 is L_eng as an example in the above-described exemplary embodiment, it may vary among the image forming sections 9.

In this case, when the time in which the photoconductor 1 is subjected to development with the developing roller 34 in each of the image forming sections 9 is set to be less than a time obtained by dividing the shortest one of the plural adjacent transfer distances by the transport speed S_blt of the intermediate transfer belt 6, toners attached to the intermediate transfer belt 6 by fogging in the image forming sections 9 do not overlap, and are separately attached to the intermediate transfer belt 6. Therefore, even when the image forming apparatus 10 includes the image forming sections 9 corresponding to plural toner colors, the image forming section 9 where fogging occurs is specified by the single toner detection sensor 14.

What is claimed is:

1. An image forming apparatus comprising:

a plurality of image forming sections arranged in a transport direction of a transfer body, the transport body transported at a predetermined speed, and each of the plurality of image forming sections including a developing section having a developer bearing member that develops an electrostatic latent image formed on a photoconductor and a developer supply unit that supplies developer to the developer bearing member, and a transfer unit that transfers the image on the photoconductor developed by the developing section onto the transfer body;

a controller that controls a driving time of the developer bearing member included in each of the plurality of image forming sections so that the developer is provided on the developer bearing member included in each of the plurality of image forming sections without forming the electrostatic latent image on the photoconductor during a period in which image formation is not performed in each of the plurality of image forming sections and so that the developer attached to the transfer body by the plurality of image forming sections does not overlap the developer of the others of the plurality of image forming sections;

a detector that detects the developer attached to the transfer body by each of the plurality of image forming sections; and a specification unit that specifies which image forming section attaches the developer to the transfer body, from the plurality of image forming sections, on the basis of a time from when the controller starts driving the developer bearing member to when the detector detects the developer attached to the transfer body.

2. The image forming apparatus according to claim 1, wherein the controller controls the driving time of the developer bearing member included in each of the plurality of image forming sections so that a time in which the developer is provided on the photoconductor by the developing bearing member is less than a time needed for the developer attached to the transfer body to move from one of adjacent transfer positions to the other transfer position, each of the transfer positions being a position where each of the plurality of image forming sections attaches the developer to the transfer body.

3. The image forming apparatus according to claim 1, wherein the detector detects an amount of the developer attached to the transfer body, wherein the specification unit specifies a supply developer amount to be supplied from the developer supply unit included in each of the plurality of image forming sections on the basis of the amount of the developer detected by the detector, and wherein the controller controls the developer supply unit included in each of the plurality of image forming sections so that the supply developer amount specified by the specification unit is supplied from the developer supply unit in the corresponding image forming section.

4. The image forming apparatus according to claim 2, wherein the detector detects an amount of the developer attached to the transfer body, wherein the specification unit specifies a supply developer amount to be supplied from the developer supply unit included in each of the plurality of image forming sections on the basis of the amount of the developer detected by the detector, and wherein the controller controls the developer supply unit included in each of the plurality of image forming sections so that the supply developer amount specified by the specification unit is supplied from the developer supply unit in the corresponding image forming section.

* * * * *